US005598938A

United States Patent [19]

Rizzardi

[11] Patent Number: 5,598,938

[45] Date of Patent: Feb. 4, 1997

[54] CAPSULES FOR INFUSION AND INJECTION BOTTLES

[75] Inventor: Vanna P. Rizzardi, Milan, Italy

[73] Assignee: Capsulit S.p.A., Milan, Italy

[21] Appl. No.: 241,794

[22] Filed: May 12, 1994

[30] Foreign Application Priority Data

May 12, 1993 [IT] Italy ..... MI930394 U

[51] Int. Cl.[6] ..... B65D 41/28; B65D 51/20

[52] U.S. Cl. ..... 215/249; 215/247; 215/317

[58] Field of Search ..... 215/247, 249, 215/317, 250, 256

[56] References Cited

U.S. PATENT DOCUMENTS

| | | | |
|---|---|---|---|
| 3,071,274 | 1/1963 | Ravn | 215/249 |
| 3,888,377 | 6/1975 | Stadler | 215/249 |
| 4,205,754 | 6/1980 | Nielsen et al. | 215/249 |
| 4,456,138 | 6/1984 | Bereziat | 215/249 X |
| 4,471,879 | 9/1984 | Conner et al. | 215/251 X |
| 4,576,298 | 3/1986 | Boik | 215/250 X |
| 4,700,860 | 10/1987 | Li | 215/317 X |
| 5,080,245 | 1/1992 | Conard | 215/249 |
| 5,316,163 | 5/1994 | von Schuckmann | 215/249 |
| 5,328,041 | 7/1994 | Hook et al. | 215/247 |

*Primary Examiner*—Allan N. Shoap
*Assistant Examiner*—Nathan Newhouse
*Attorney, Agent, or Firm*—Michael J. Striker

[57] ABSTRACT

A capsule of plastic material for infusion bottles comprises a capsule body adapted to be fitted on a neck of a bottle for retaining a pierceable plug in place, and a capsule cap to be fitted on the capsule body, the capsule body having a top wall provided with a hole and a downwardly extending annular ridge formed around the hole at a distance from the latter, the capsule cap having a plug formed so as to fit into the hole of the capsule body and provided with an annular rim on its periphery so as to be folded outwardly and to fit into a space defined by the pierceable plug, the top wall of the capsule body and the annular ridge of the capsule body.

6 Claims, 3 Drawing Sheets

CAPSULES FOR INFUSION AND INJECTION BOTTLES

BACKGROUND OF THE INVENTION

The present invention relates to a capsule composed of a plastic material, and used in particular for infusion and injection bottles and the like.

More particularly, it relates to such a capsule which is formed to maintain a condition of sterilization at an area to be pierced by a needle.

Capsules of the above mentioned general type are known in the art. A known capsule includes the capsule body to be fitted on a neck of a bottle for retaining a pierceable plug in place, and a capsule cap which is fitted on the capsule body.

It is known that bottles for containing drugs such as infusion liquids or the like are generally closed by a pierceable rubber plug which is retained in place by a capsule of aluminum, and the aluminum capsule is secured by seaming to the bottle neck to cover the entire rubber cap. The capsule has a weakening line formed on its central wall for permitting a central portion of the capsule wall to be easily removed so as to give access to the underlying rubber ring and to pierce the latter for drawing off a product.

Aluminum capsules involve, however, some disadvantages. First of all, they cannot be mounted while being maintained in a sterilized environment. The reason is that because the sheet folding operation that is necessary to fix by seaming the capsule to a bottle neck causes a certain quantity of aluminum powder to be produced, whose dispersion in the environment would destroy the sterilized condition. The same as above occurs with lubricant that has to be used in machines for manufacturing aluminum capsules. As a result, aluminum capsules are mounted in a not sterilized environment. Also, it frequently occurs that a user cuts or hurts himself in pulling up this material. It is therefore desirable that a different material, for example a material which does not involve the above described problems could be resorted to, for example, a plastic material.

Several efforts have been made to this extent, but none of them was brought to a successful result. A plastic material in effect either does not withstand such high temperatures as required for autoclaving, or it is expanded and/or distorted to such an extent that it cannot secure sterilized conditions to be maintained inside the capsule. Conversely, when using a material that withstands high temperatures and is of sufficient thickness to avoid excessive distortion, the capsule is too thick and is difficult to rupture for removing the cap. The existing capsule can be improved in some aspects.

SUMMARY OF THE INVENTION

Accordingly, it is an object of the present invention to provide a capsule for infusion and injection bottles, which is a further improvement of existing capsules.

In keeping with these objects and with others which will become apparent hereinafter, one feature of the present invention resides, briefly stated, in a capsule which has a capsule body provided with a central hole surrounded at a short distance by an annular ridge formed on the lower wall, and a capsule cap provided with a cylindrical plug which is formed for closing the hole in the capsule body and has an annular ridge that can be folded outwardly so as to fit below the capsule body close the annular ridge in order to retain the cap in place.

When the capsule body with its associated cap is fixed in place, the lower flat wall of the body will be in contact with the closing plug of the bottle so as to prevent air pockets from forming between the capsule and the cap and to contribute to maintaining conditions of sterilization.

The configuration of the above described components is such that after an annular edge has been folded to fit underneath the capsule body, the bottom wall of the plug of the capsule cap is thoroughly flat and in contact with the bottle rubber plug therefore the formation of any air pocket is avoided and maintaining of sterilized conditions is improved.

In accordance with another feature of the present invention, the capsule can be provided with a safety ring which helps an end user to immediately identify any tempering with the capsule.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
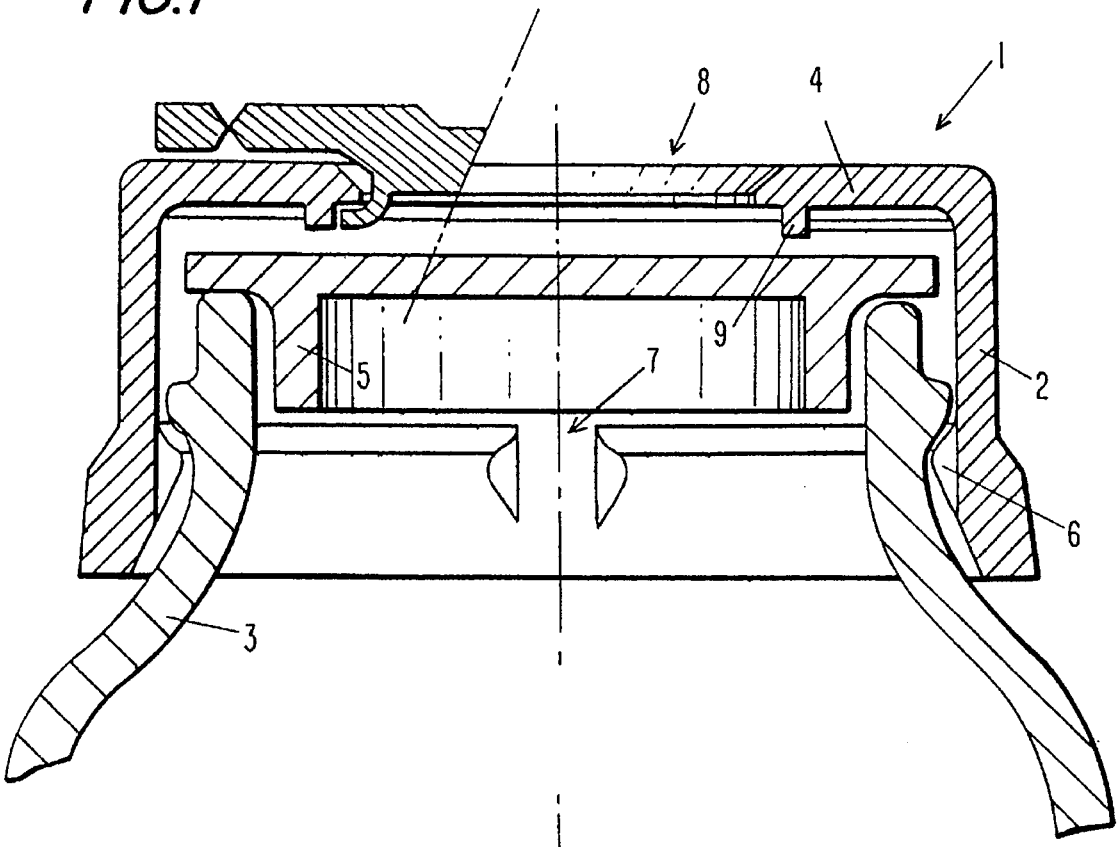
FIG. 1 is a view showing a section of a capsule body of a capsule in accordance with the present invention.

A capsule in accordance with the present invention has a capsule body which is generally designated with reference numeral 1 in FIG. 1. The capsule body has a side wall 2 for fitting around a neck of a bottle 3, and a top wall 4 adapted to rest on a rubber, pierceable plug 5 which closes the bottle 3.

The capsule body 1 is provided on its lower internal edge with an annular ridge 6 for engagement with a corresponding ridge on an external edge of the bottle, so as to retain the capsule in place. The annular ridge 6 is discontinuous. In other words, it is formed of a number of ridge portions spaced from one another by a distance 7. This permits the capsule body to undergo a greater elastic deformation upon its putting in place. The ridge 6 can have a more protruding shape so as to insure that a more firm grip on the neck of the bottle can be obtained.

The top wall 4 of the closure body is provided with a central hole 8. An annular ridge 9 extends downwardly from a lower surface of the top wall 4 and is slightly spaced from the hole 8. The annular ridge 9 is formed so that after the capsule has been fitted to the bottle neck, the ridge 9 rests on the plug 5.

Figure 2:
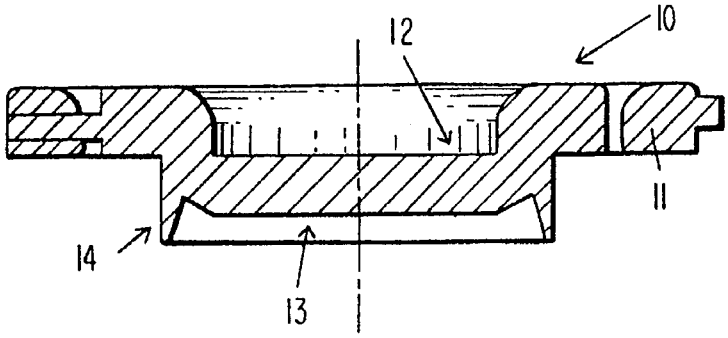
FIG. 2 is a sectional view of a capsule cap for fitting to the capsule body of FIG. 1, with the capsule cap provided with a grip ring on its circumference.

The capsule is closed by a capsule cap designated with reference numeral 10 in FIG. 2. The capsule cap 10 has a grip ring 11 on its circumference, and a closing plug designated with reference numeral 12 and provided in a central area for fitting into the hole 8 of the capsule body 1. The lower wall 13 of the cap 12 is flat and is circumferentially limited by an annular rim 14. The rim 14 is adapted to be folded outwardly for engaging below the top wall 4 of the capsule body, inside the annular ridge 9.

Figure 3:
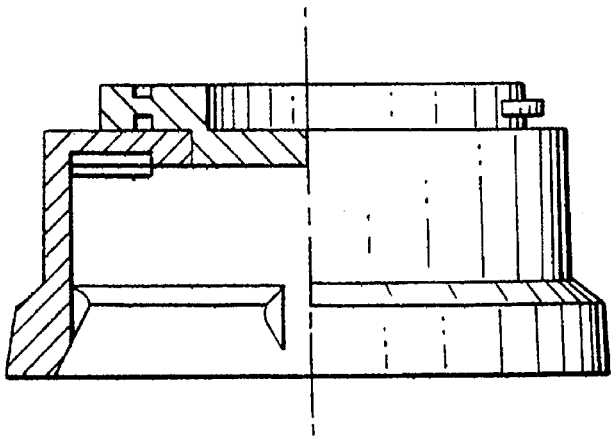
FIG. 3 is a view showing a partial section of the capsule fitted with the capsule cap.
Figure 1A:
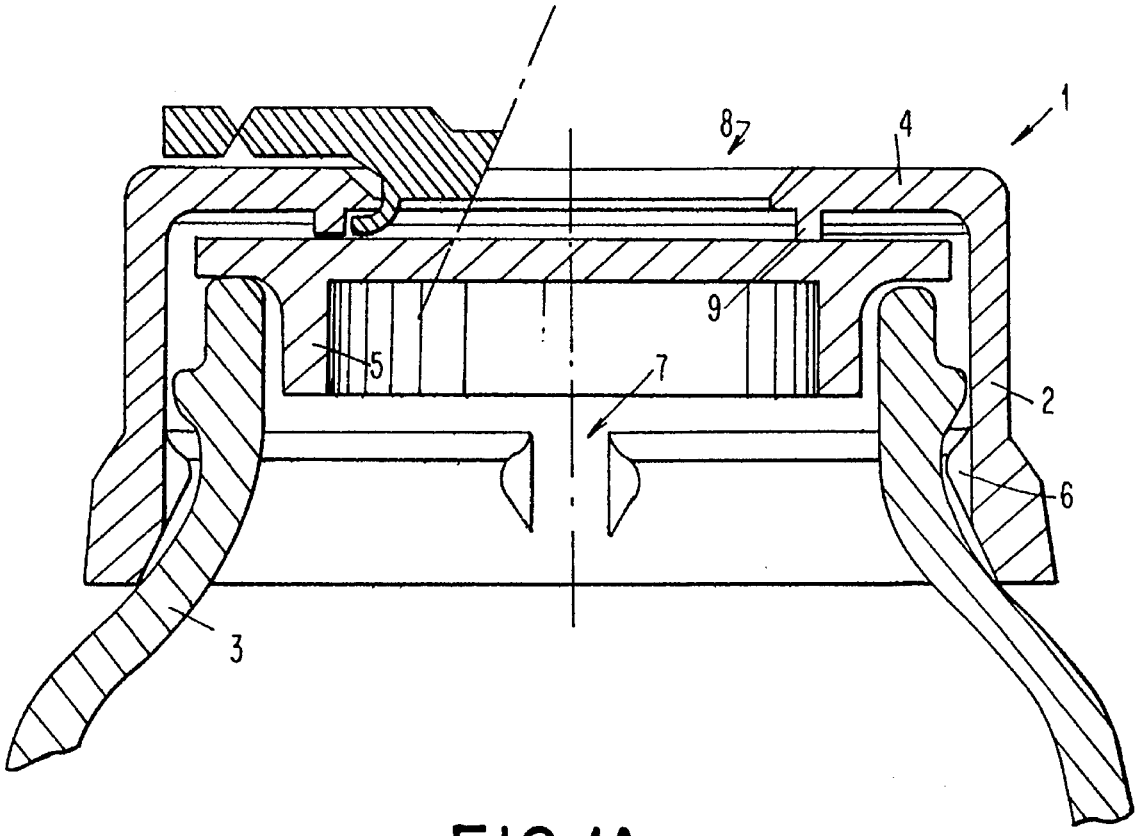
FIG. 1A is sectional view of the invention showing the capsule securely on a bottle.

The rim 14 of the capsule cap 10 has a thickness substantially corresponding to the height of the annular ridge 9, so that when the folded rim is fitted below the wall 4 of the capsule body, it will be substantially in alignment with both the lower face 13 of the plug 12 and the lower face of the annular ridge 9. As a result, these three elements are coplanar with each other and they rest on the bottle closing cap 5 as shown in FIG. 3. Therefore air pockets are prevented from forming between the capsule body and the cap, to ensure that sterilized conditions can be maintained.

The capsule cap 10 is fixed, for example by heat-sealing and can be easily removed by simply grasping the grip ring 11 and then tearing up the cap from it seat, to get access to the underlying pierceable plug.

Figure 5:
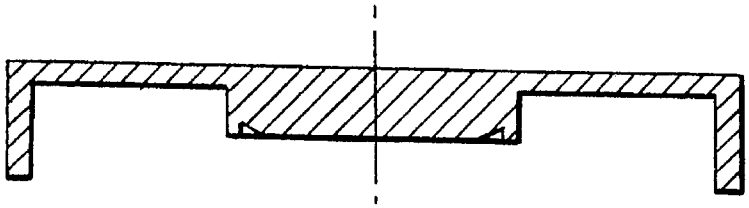
FIG. 5 is a sectional view of a different embodiment of a cap for a capsule in accordance with the present invention.

The capsule cap 10 can be modified to have other forms, such as for example the capsule cap shown in FIG. 5. However, in any modification a closing plug having the above described features must be provided in the central area of the cap and formed so as to fit into the hole 8 of the capsule body.

Figure 4:
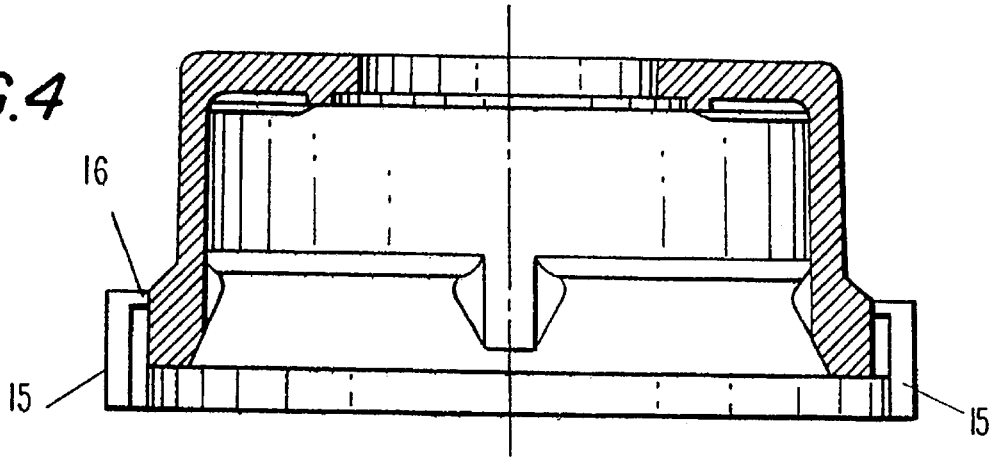
FIG. 4 is a sectional view of a capsule according to the present invention, which is provided with a safety seal.
Figure 6:
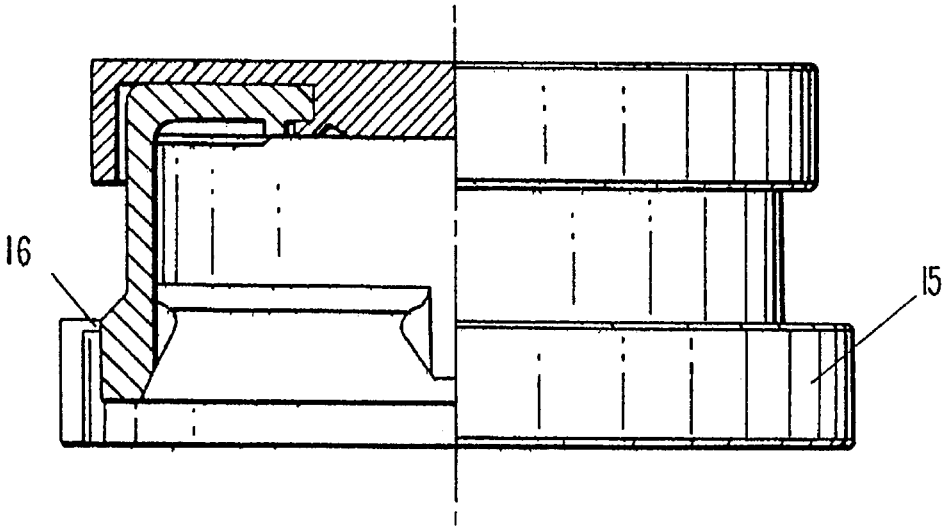
FIG. 6 is a partial sectional view of the capsule of FIG. 4 with the cap of FIG. 5.

The capsule in accordance with the present invention may be further provided with a safety seal, formed for example as a strip 15 of plastic material as shown in FIGS. 4 and 6. The strip 15 is connected by bridges 16 to a lower portion of the capsule body 1 and is ruptured if the capsule is removed from the bottle.

The dimensions and materials used for the capsule may be varied depending on particular application requirements.

It will be understood that each of the elements described above, or two or more together, may also find a useful application in other types of constructions differing from the types described above.

While the invention has been illustrated and described as embodied in capsules for infusion and injection bottles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A capsule of plastic material for infusion bottles, comprising a capsule body adapted to be fitted on a neck of a bottle for retaining a pierceable plug in place; and a capsule cap to be fitted on said capsule body, said capsule body having a top wall provided with a hole and a downwardly extending annular ridge formed around said hole at a distance from the latter, said capsule cap having a plug formed so as to fit into said hole of said capsule body and provided with an annular rim on its periphery so as to be folded outwardly and to fit into a space defined by said pierceable plug, said top wall of said capsule body and said annular ridge of said capsule body, said plug of said capsule cap having a height which is equal to a thickness of said top wall of said capsule body plus a height of said annular ridge, so that when said capsule cap has been fitted on said capsule body, a lower wall of said plug and the bottom edge of said annular rim are on a same plane to rest against the plug.

2. A capsule as defined in claim 1, wherein said annular rim has a thickness substantially corresponding to a height of said annular ridge so that after said annular rim has been folded, said annular rim is in alignment with a lower wall of said plug and the bottom edge of said annular ridge.

3. A capsule as defined in claim 1, wherein said capsule body has an internal annular ridge with a lower edge engageable with a corresponding ridge on an edge of the bottle, said annular ridge being composed of a plurality of ridge portions spaced from one another by a distance.

4. A capsule as defined in claim 1; and further comprising a grip ring secured to said capsule cap for grasping the latter.

5. A capsule as defined in claim 4; and further comprising means for fixing said capsule cap and said grip ring to said capsule body and including a heat sealing seam.

6. A capsule as defined in claim 1, wherein said identifying means includes a strip fixably connected to said lower portion capsule body by a plurality of bridges which are rupturable as a result of a tampering attempt.

* * * * *